United States Patent [19]

Harris

[11] 4,196,484

[45] Apr. 8, 1980

[54] PLATFORM BED BASE WITH CONNECTOR PLATE

[75] Inventor: George M. Harris, Chicago, Ill.

[73] Assignee: Harris-Hub Co., Inc., Harvey, Ill.

[21] Appl. No.: 959,700

[22] Filed: Nov. 13, 1978

[51] Int. Cl.[2] ..... A47C 19/00

[52] U.S. Cl. ..... 5/201; 5/282 R; 5/286

[58] Field of Search ..... 5/176 R, 181, 200 R, 5/201, 207, 282 R, 286, 431, 440, 474, 568; 248/188

[56] References Cited

U.S. PATENT DOCUMENTS

| | | | |
|---|---|---|---|
| 3,501,786 | 3/1970 | Hurwitz | 5/201 |
| 3,646,623 | 3/1972 | Harris et al. | 5/181 |
| 3,713,181 | 1/1973 | Hougland | 5/201 |
| 3,869,738 | 3/1975 | Lawrence | 5/200 R |
| 4,106,141 | 8/1978 | Hooker | 5/181 |

*Primary Examiner*—Casmir A. Nunberg

[57] ABSTRACT

A platform bed frame for a platform bed is provided which is capable of supporting a conventional mattress and box spring combination, or a mattress alone. The platform bed frame includes side plates and end plates which are connected together at each corner of the bed frame by a plate having downwardly extending pins which are received in apertures defined by the side plates and end plates.

33 Claims, 18 Drawing Figures

PLATFORM BED BASE WITH CONNECTOR PLATE

BACKGROUND OF THE INVENTION

This invention relates to platform bed frames for platform beds, and specifically to a connecting means for securing the side plates and end plates of a platform for a platform bed together.

For a number of years, platform beds, which consist of a mattress sitting on a platform, have been widely used in Europe but have not been widely accepted in the more affluent United States. A major reason for the popularity of these beds in Europe is that living quarters generally have much less space than is the case in the United States, and platform beds are more space-efficient than the conventional Hollywood-type beds which have almost totally dominated the domestic market. Recently, there has been an upsurge of interest in this country in platform beds, and this new founded popularity is generally attributed to apartment dwellers who must make more efficient use of space than home owners. In addition, platform beds blend well with modern furniture, and especially well with modular furniture that is popular in many apartment dwellings because it maximizes the use of floor space. Also, platform beds have a number of other advantages over the conventional Hollywood beds. For example, the exposed legs of conventional Hollywood bed frames are a major cause of many household accidents, notably stubbed toes, and the like. Platform beds do not have exposed legs, and thus are not as likely to cause such accidents. And, because a platform bed does not have legs and sit on the floor, it totally encloses the floor space upon which it rests, and thus obviates the need to dust or vacuum underneath the bed.

The platform bed frame or platform of a platform bed, generally includes two side plates or panels, which are joined to transversely disposed end plates by conventional coupling members, such as screws and bolts, and the like. One problem with joining platform bed frames in this manner is that in some cases the screws and bolts are visible on the outer portion of the platform and detract from its appearance. Another problem is that screws and bolts are easily lost during shipment. Thus, it is desirable to fabricate side plates and end plates which have coupling members in a form which is not easily lost, and which are preferably secured on the side plates and end plates so that they may be shipped without any loose parts and in a condition whereby a consumer can merely slide the side plates and end plates together in a matter of minutes to form the platform bed.

Another problem with most prior art platform bed frames for platform beds, is that they have been usually designed to support only a mattress, and not the conventional box spring and mattress combination which is used on a Hollywood bed frame. When a conventional mattress is used on a platform bed frame, it is not as comfortable as the mattress box spring combination used on a Hollywood bed frame, because the box spring provides an extra amount of cushioning that increases the comfort of the conventional mattress. To overcome this problem, specially made mattresses have been designed for use on platform bed frames. However, these specially designed mattresses are not as readily available as conventional mattresses, and are generally more expensive. Moreover, potential users of platform beds may desire to use a mattress which they already own, and may be unwilling to spend extra money to purchase a specially-made mattress. Consequently, price and comfort considerations may deter some potential purchasers from buying platform beds. Thus, the availability of a platform bed frame which could support the conventional box spring and mattress combination, could alleviate this problem, and provide more people with a viable option of using platform beds with their consequent safety and utility advantages.

SUMMARY OF THE INVENTION

In accordance with the present invention, a platform bed frame or base for a platform bed is provided which is capable of supporting a conventional mattress and box spring combination, or a conventional mattress alone. Preferably the side plates and end plates are metal and are provided with connecting means which may be interlocked without using screws and bolts.

More specifically, the platform bed base comprises a pair of spaced parallel side plates having substantially identical dimensions. Each side plate includes a wall portion that defines an upper edge and a lower edge and is disposed generally vertically in relation to the floor. A generally horizontal upper member is integral with the upper edge of the wall portion, and a generally horizontal foot portion is integral with the lower edge of the wall portion for confronting the surface area upon which the platform is situated. The upper horizontal members may provide horizontal support for the frame portion of a box spring so that the box spring may be disposed directly on the platform bed frame.

The platform bed base further includes a pair of end plates that are longitudinally spaced with respect to the side plates and extend perpendicularly between them so that the end plates and side plates together define a substantially rectangular platform bed base. Each end plate has substantially the same dimensions and includes an intermediate portion which defines an upper edge and a lower edge and is disposed generally vertically in relation to the floor. The end plates each have a generally horizontal upper arm portion which is integral with the upper edge of the intermediate portion, and a generally horizontal lower leg portion that is integral with the lower edge of the intermediate portion for confronting the surface upon which the platform is situated.

Connecting means is employed to detachably secure each of the end plates to each of the side plates to form a generally rectangular platform. The connecting means comprises a bracket having male members along one surface thereof. The ends of the side plates and end plates are provided with female members that coact with the male members. The male and female members are engaged with one another when the ends of the side plates and end plates are positioned adjacent to one another.

The male members preferably take the form of pins that are permanently secured to the bracket and extend downwardly from one face thereof, while the female members preferably comprise apertures for receiving the pins. The apertures are preferably provided along the upper horizontal members of the side plates and the upper arm portions of the end plates. The connecting means is positioned with the one face disposed in surface to surface engagement with the upper horizontal members of the side plates and the upper arm portions of the end plates. The connecting means includes four brackets—one at each corner of the platform bed base. When the pins are engaged with the corresponding apertures, the platform bed base is assembled.

DETAILED DESCRIPTION OF THE PREFERRED EMBODIMENTS

Figure 1:
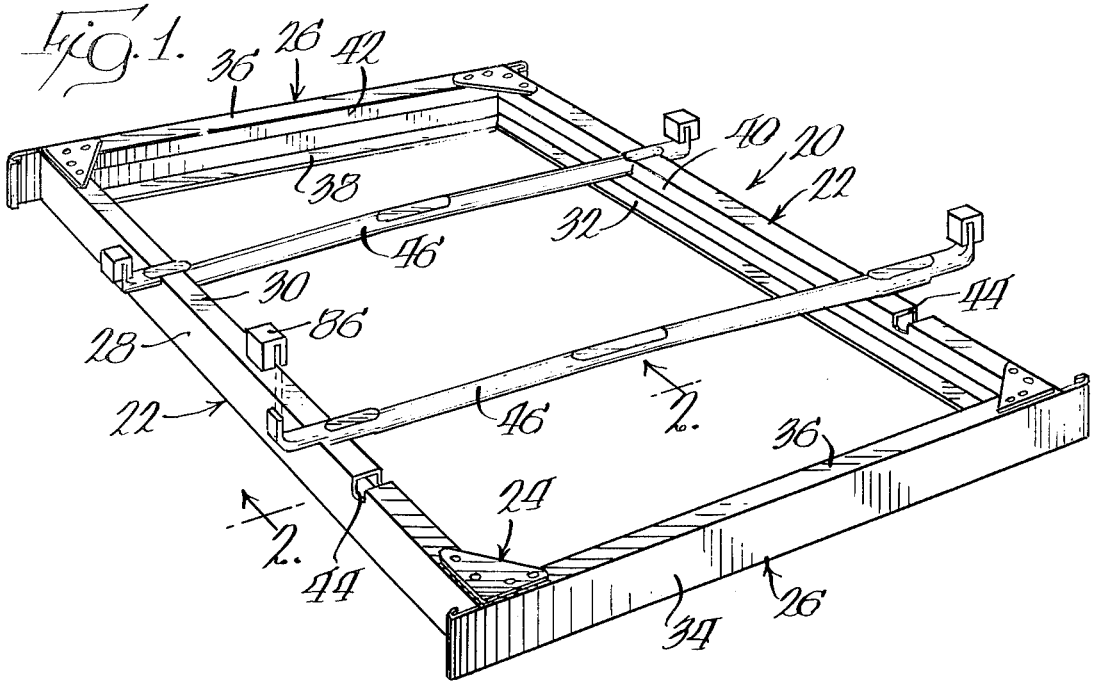
FIG. 1 is a partially exploded perspective view of a platform bed base in accordance with the present invention.

While this invention is susceptible of embodiment in many different forms, there is shown in the drawings and herein will be described in detail preferred embodiments of the invention, with the understanding that the present disclosure is to be considered as an exemplification of the principles of the invention and is not intended to limit the invention to the embodiments illustrated. The scope of the invention will be pointed out in the appended claims.

Several illustrative embodiments of the invention are shown in the Figures and will be described herein. Reference numbers between 20–99 are used to refer to the elements in the embodiment illustrated in FIGS. 1–5. The embodiment shown in FIGS. 6–8 has reference numbers in the 100 series, the embodiment illustrated in FIGS. 9–14 has reference numbers in the 200 series and the embodiment shown in FIGS. 15–18 has reference numbers in the 300 series, and the same last two digits in each number designate like elements in the various embodiments.

Referring now to the drawings, FIG. 1 shows a platform bed frame which, for purposes of convenience, is hereinafter referred to as a platform. The platform 20 includes side plates 22 which are in spaced relationship with one another and are interconnected by detachable securement means 24 to end plates 26 which extend perpendicularly between the side plates to form a generally rectangular platform. A mattress (not shown) is suitably disposed on the platform 20 in use.

The side plates 22 of the platform are parallel and have substantially the same dimensions. Each side plate has substantially vertical wall portion 28 which has an upper edge and a lower edge. An upper horizontal member 30 is integral with the upper edge of the wall portion 28 and extends inwardly from the wall portion towards the other side plate. A generally horizontal foot portion 32 is integral with the lower edge of the wall portion 28 and also extends inwardly from the wall portion towards the other side plate. The upper horizontal member 30 and foot portion 32 are substantially parallel to one another and together with the vertical wall portion 28 form a generally C-shaped section, with the foot portion 32 confronting the surface upon which the platform is situated.

The end plates 26 are also parallel and have substantially the same dimensions. Each end plate has a substantially vertical intermediate portion 34 which has an upper edge and a lower edge. A generally horizontal upper arm portion 36 is integral with the upper edge of the intermediate portion 34 and extends inwardly from the intermediate portion towards the other end plate. A generally horizontal lower leg portion 38 is integral with the lower edge of the intermediate portion 34 and also extends inwardly from the intermediate portion towards the other end plate. The upper arm portion 36 and lower leg portion 38 are substantially parallel to one another and together with the intermediate portion 34 form a generally C-shaped section, with the lower leg portion 38 confronting the surface upon which the platform is situated.

Figure 2:
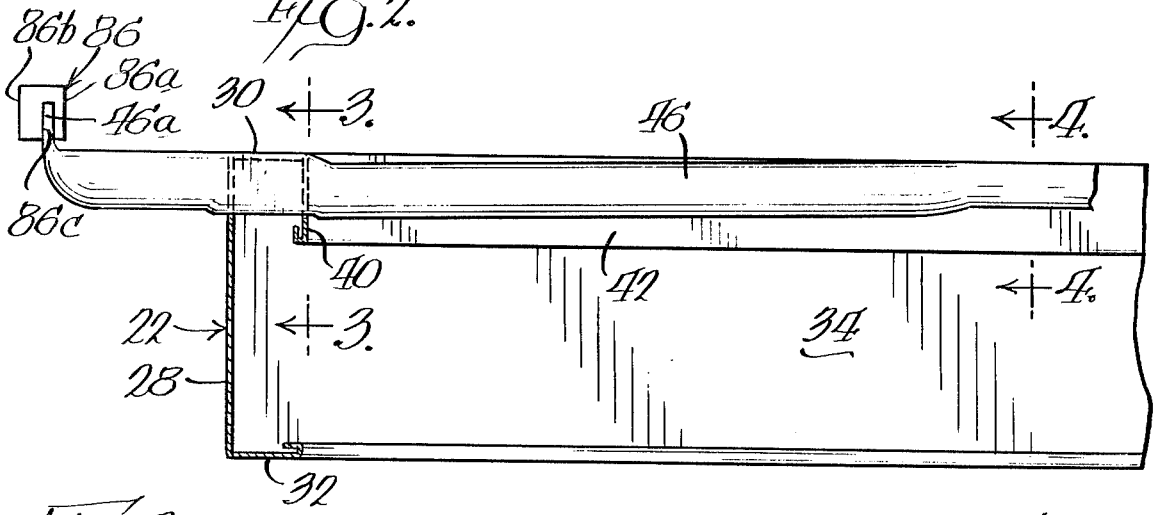
FIG. 2 is an enlarged fragmentary cross-sectional view taken along plane 2—2 in FIG. 1.
Figure 3:
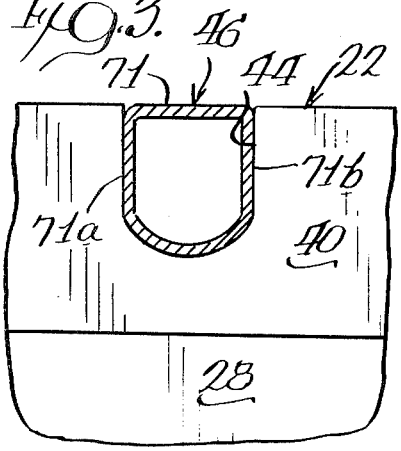
FIG. 3 is an enlarged fragmentary cross-sectional view taken along plane 3—3 in FIG. 2.
Figure 4:
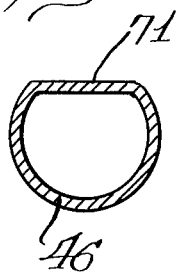
FIG. 4 is an enlarged cross-sectional view taken along plane 4—4 in FIG. 2.
Figure 5:
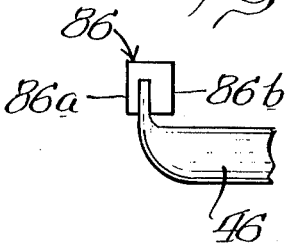
FIG. 5 is an enlarged fragmentary elevational view of the cross support member and stop means shown in FIG. 1.

As shown in FIGS. 1 and 2, the upper horizontal member 30 and upper arm portion 36 each include an inner end, and the side plates 22 and end plates 26 each further include a generally vertical downwardly extending flange 40 and 42, respectively. Preferably, the flanges extend less than one-half the height of the vertical wall portion 28 and intermediate portion 34 and provide greater strength to the side plates and end plates. As shown, the lowermost edge of the flanges may be folded inwardly so that sharp edges of the side plates and end plates are not exposed. Similarly, the foot portion 32 and leg portion 38 have inner edges which preferably are folded over so that sharp edges of the side plates and end plates are not exposed.

The side plates 22 each have at least one transversely extending channel or notch 44 along the uppermost portion of the side plate. As shown in FIG. 1, the notches 44 are defined by cut-out portions along vertical wall portion 28, upper horizontal member 30 and flange 40. The notches 44 in each side plate are aligned with corresponding notches in the other side plate. At least one cross support member 46 extends between the side plates for supporting the mattress, and each cross support member is positioned within a pair of aligned notches.

The side plates 22 and end plates 26 are detachably secured together to form a generally rectangular platform. In order to accomplish this, the adjacent ends of each end plate and side plate are detachably secured together at two spaced-apart locations for firm securement.

Figure 7:
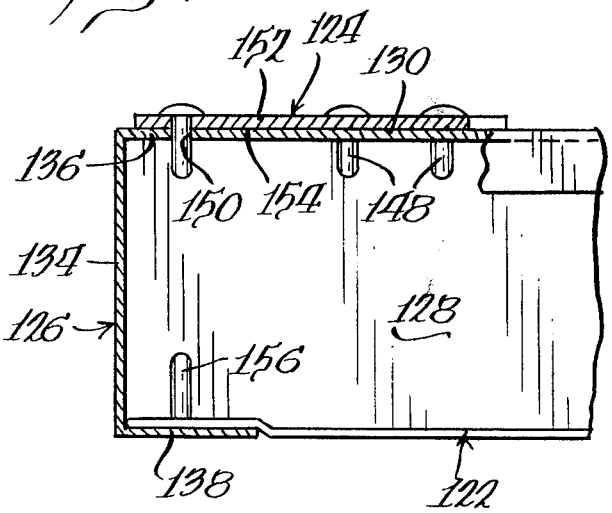
FIG. 7 is an enlarged fragmentary cross-sectional view taken along plane 7—7 in FIG. 6.
Figure 8:
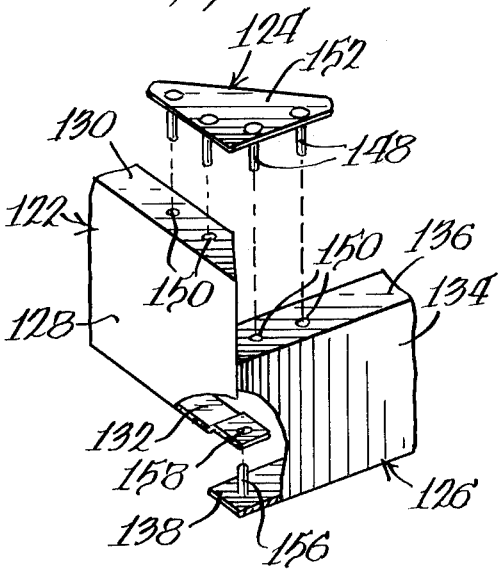
FIG. 8 is an exploded perspective view, on an enlarged scale, of the connector means and a portion of a side plate and end plate shown in FIG. 6.

In all of the embodiments, the ends of each upper horizontal member 30 are secured to the adjacent ends of the upper arm portion 36 by securement means shown generally at 24 in FIG. 1. The securement means of the embodiments of FIGS. 1 and 7 is the same, and is best shown in FIGS. 7 and 8. Such securement means preferably comprises a bracket that is a generally flat plate having an exposed top major face 152 and a bottom major face 154. The plate preferably is in the shape of a right triangle and the lesser angles are both about 45°. The bracket 124 has male members 148 which engage female members 150 in the upper horizontal member 130 and upper arm portion 136 when the upper ends of the side plates 122 and end plates 126 are positioned adjacent to one another. In the illustrated embodiment, the adjacent ends of the upper horizontal member 130 and upper arm portion 136 are beveled and are at an angle of about 45° relative to the respective upper edges of vertical wall portion 128 and intermediate portion 134. The beveled edges contact one another when the side plates and end plates are secured together.

To secure each side plate and end plate together, a bracket 124 is positioned with the male members 148 engaging the female members 150, and the bottom major face is in surface to surface engagement with the upper horizontal member 130 of side plate 122 and the upper arm portion of end plate 126.

As depicted in FIG. 8, the male members 148 preferably comprise a plurality of cylindrical pins projecting outwardly in the downward direction from the bottom major face of bracket 124, and the female members 150 are preferably a plurality of spaced-apart apertures defined by upper horizontal member 130 and upper arm portions 136. The apertures correspond to the pins and have a diameter at least as great as the diameter of the pins. The pins in each bracket are receivable in the apertures at one end of the upper horizontal member 130 and one end of the upper arm portion 136. The pins may comprise rivets which extend through the bracket and project outwardly therefrom.

The second location where the adjacent ends of each end plate and side plate are detachably secured together is also best illustrated in FIGS. 7 and 8 and comprises a second male member 156 on the lower leg portion 138 of end plate 126 which engages a second female member 158 on the foot portion 132 of side plate 122. The second male member 156 preferably comprises a pin extending upwardly from each end of lower leg portion 138 of each end plate 126, and the second female member 158 preferably comprises an aperture defined by each end of the foot portion 132 of each side plate 122. The pin is receivable in the aperture and extends through the aperture, and the ends of the lower leg portion 138 and foot portion 132 are positioned in overlapping surface to surface contact. As shown, the end of the foot portion 132 overlies the end of the lower leg portion 138, and the end of the foot portion may be bent upwardly by an amount corresponding to the thickness of the leg portion so that the remaining portion of the foot portion and the entire length of the leg portion are available to confront the surface upon which the platform 120 is situated.

To connect the end plates and side plates, each end of the side plates is raised slightly and is then lowered so that the pins 156 in the lower leg portion 138 of the end plate are received in and engage the apertures 158 in the foot portion 132 of the side plate. This first step connects the bottom portions of the side plates and end plates and also performs a locating function to facilitate the second step—securing together the upper portions of the side plates and end plates.

Figure 6:
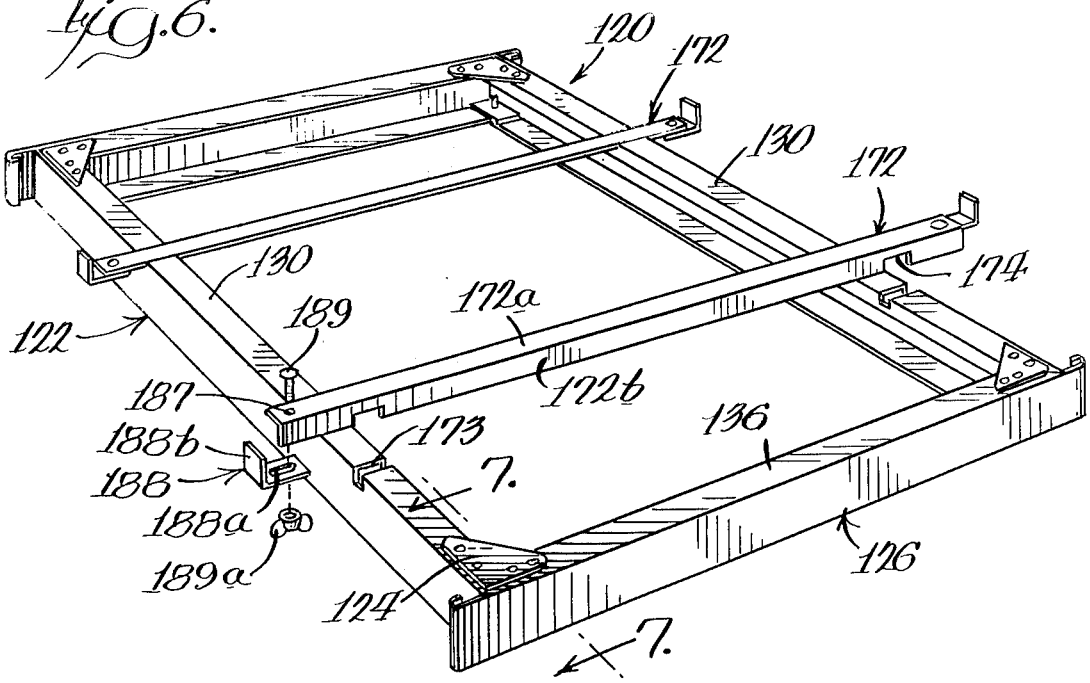
FIG. 6 is a partially exploded perspective view of another embodiment of the present invention.

The second step is performed by taking a bracket 124 and moving it downwardly so that one pair of pins 148 is received in the pair of apertures 150 in the upper arm portion 136 of the end plates and the other pair of pins 148 is received in the pair of apertures 150 in the upper horizontal member 130 of the side plate. Four plates are used—one at each corner of the platform where a side plate and end plate are adjacent to one another. There are two edges of bracket 124 which are at right angles to each other, and one of the edges overlies the upper edge of the vertical wall portion 128 of the side plates and the other overlies the upper edge of the intermediate portion 134 of the end plate. The embodiment of FIG. 8, when assembled, appears as shown in FIG. 6, and produces an extremely rigid structure.

According to a further feature of this invention, the bracket may include means for securing a headboard to the platform. As shown in FIGS. 9 and 12–14, bracket 224 includes an upstanding wall portion 260 which is disposed generally vertically in relation to the floor and generally perpendicularly to the top major face 252 of the bracket. The wall portion 260 extends upwardly from the edge of bracket 224 that overlies the upper edge of the intermediate portion 234, and extends outwardly beyond the edge of the bracket that overlies the upper edge of the vertical wall portion 228. Thus, the upstanding wall portion has a greater width than the top major face 252 of the bracket. The wall portion 260 of bracket 224 defines at least one horizontally extending slot 262 through which a screw can be inserted for securing a headboard to the bracket 224. The bracket may further include a flattened portion 264 which is perpendicular to and extends inwardly from the bottom edge of the upstanding wall portion. The flattened portion 264 also extends to the edge of top major face 252 which overlies the upper edge of the vertical wall portion 228. The flattened portion can provide support for the legs of the headboard. All portions of the bracket 224, including the plate in which top major face 252 is the upper surface, upstanding wall portion 260, and flattened portion 264, preferably are integral and may be formed from sheet metal.

Figure 12:
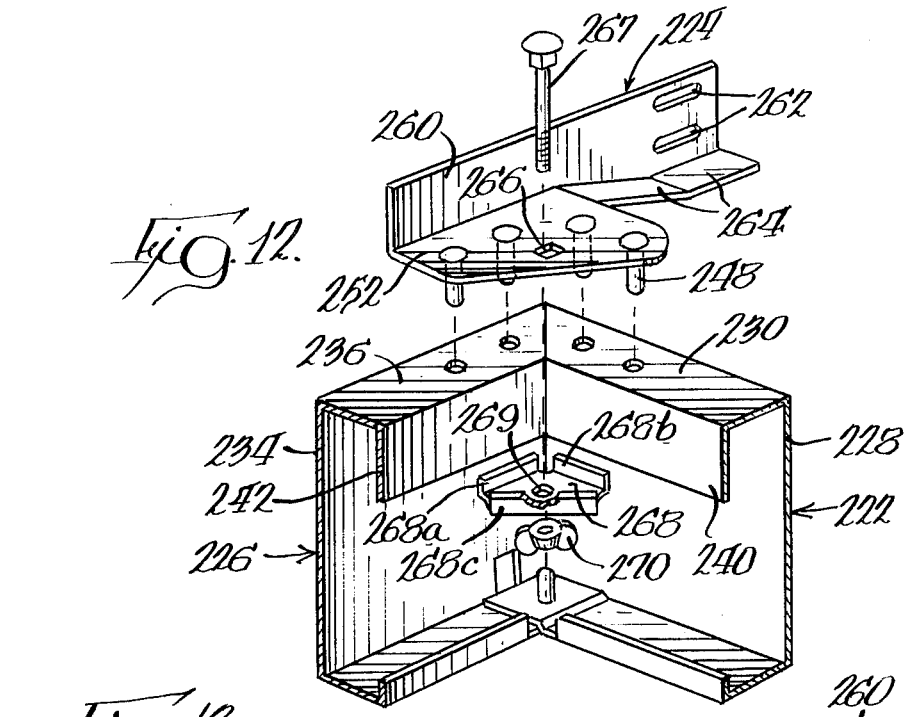
FIG. 12 is an exploded perspective view, on an enlarged scale, of the connector means and a portion of a side plate and end plate shown in FIG. 9.
Figure 13:
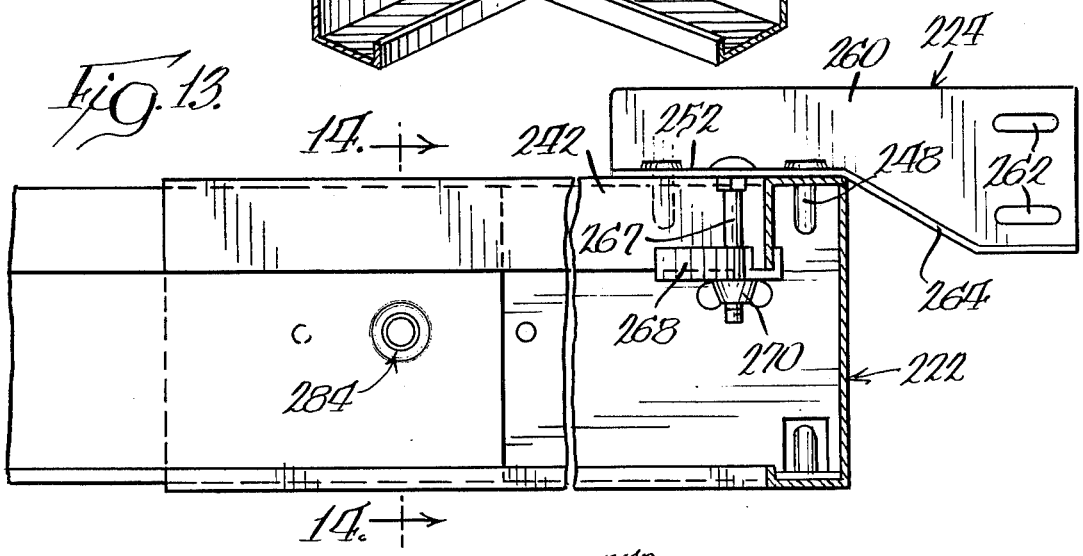
FIG. 13 is an enlarged fragmentary cross-sectional view taken along plane 13—13 in FIG. 9.
Figure 14:
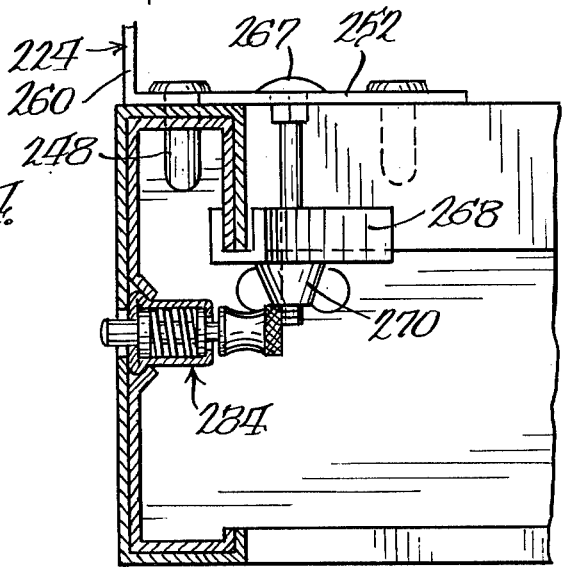
FIG. 14 is an enlarged fragmentary cross-sectional view taken along plane 14—14 in FIG. 13.

To provide additional support for the headboard, the portion of the bracket 224 having pins 248 defines a square aperture 266 through which a square neck carriage bolt 267 is receivable, as shown in FIG. 12, with the square neck of the bolt 267 being restrained from turning by the sides of opening 266. A plate member 268 which may be generally triangular in shape and has upturned sides **268*a*, 268*b* and 268*c* also defines an aperture 269 through which the bolt 267 is receivable. When the bolt 267 is extended through the apertures 266 and 269, a wing nut 270 is tightened until the upper surface of plate member 268 contacts the lower edges of flanges 240 and 242. The aperture 266 is positioned such that the bolt 267 is disposed inwardly of flanges 240 and 242 so that the bolt need not pass through either upper horizontal member 230 or upper arm portion 236. The plate 268 provides further strength for holding the side plate 222 and end plate 226 together in that side 268*a* engages the surface of flange 242 facing end plate 226 and side 268*b* engages the surface of flange 240 facing side plate 222, while side 268c is juxtaposed to and extends between the opposite surfaces of flanges 240 and 242. The completed structure which is ready to have a headboard secured thereto is depicted in FIGS. 13 and 14**.

Various embodiments are depicted in which the cross support members 46 provide some or all of the support for the mattress. In the embodiment illustrated in FIGS. 1-3, the cross support member 46 supports the mattress together with the upper horizontal member 30 of each side plate and the upper arm portion 36 of each end plate. As shown in FIGS. 1-4, the cross support member 46 is a bowed tube that has a generally horizontal central segment and has end segments that are curved upwardly between the side plates and the central segment. The term "curved upwardly" is to be construed herein as meaning that the cross support member 46 is at an angle relative to horizontal along the end segments of the cross support member, and the distance between the floor and the cross support member increases along the end segments between the side plates and the central segment of the cross support member.

Throughout a major portion of its length, the cross support member is a closed tube which is generally cylindrical and hollow. Along the central segment, and the portions of the end segments overlying the side plates, the cross support member is flattened to produce a flat top surface 71. The sides of the end segments overlying the side plates are also flattened to form flat walls 71a and 71b which are adapted to engage the spaced-apart side walls of notch 44 to prevent twisting or transverse movement of the cross support member 46. The cross support member is bent adjacent to the side rails so that the flat top surfaces 71 along the central segment and the end segments are coplanar and extend horizontally along the top of the cross support member parallel to the floor and approximately coplanar with the upper horizontal members 30 and upper arm portions 36. Moreover, there is no portion of the cross support members that is elevated above the flat top surfaces 71. Thus, the mattress is supported by the cross support members along the flat top surfaces 71, and is further supported by the upper horizontal members 30 of the side plates and the upper arm portions 36 of the end plates. Notch 44 has a bottom wall which extends between the side walls of the notch and preferably is contoured to correspond to the configuration of the bottom of the cross support member 46. In the embodiment illustrated in FIGS. 1—3, cross support member 46 is supported by the bottom wall of the notch.

The embodiment shown in FIG. 6 has cross support members 172 which are received in notches 173. The cross support members are generally L-shaped angle irons having a generally flat horizontal panel 172a and a generally flat vertical panel 172b extending for the length of the horizontal panel and perpendicular thereto. The notches 173 have a width about equal to the thickness of the vertical panel 172b of the cross support member so that the opposing faces of the vertical panel 172b are adapted to engage the spaced-apart side walls of the notch to prevent transverse movement of the cross support member. To prevent longitudinal movement of the cross support members, opposing ends of the vertical panel 172b of each cross support member are provided with notches 174 which engage and interlock with notches 173. The flat horizontal panel 172a of each cross support member overlies and is in surface to surface engagement with the upper horizontal member 130 adjacent to notches 173.

The cross support members 172 project above the plane of the upper horizontal members 130 and upper arm portions 136 by a distance equal to the thickness of the flat horizontal panel 172a. However, the flat horizontal panel 172a has a relatively small thickness, so that the flat horizontal panel 172a is generally coplanar with upper horizontal members 130 and upper arm portions 136. Thus, the upper horizontal members 130 and upper arm portions 136 as well as the cross support members 172 provide support for the mattress. Likewise, in all of the embodiments, the brackets 124 project upwardly above the plane of the upper horizontal members 130 and upper arm portions 136, but the relatively small thickness of the brackets 124 results in the brackets being generally coplanar with the upper horizontal members and upper arm portions. Thus, the thickness of the brackets 124 does not prevent the cross support members (and the upper horizontal members 130 and upper arm portions 136 as well, when desired) from supporting and bearing the load of the mattress.

Figure 9:
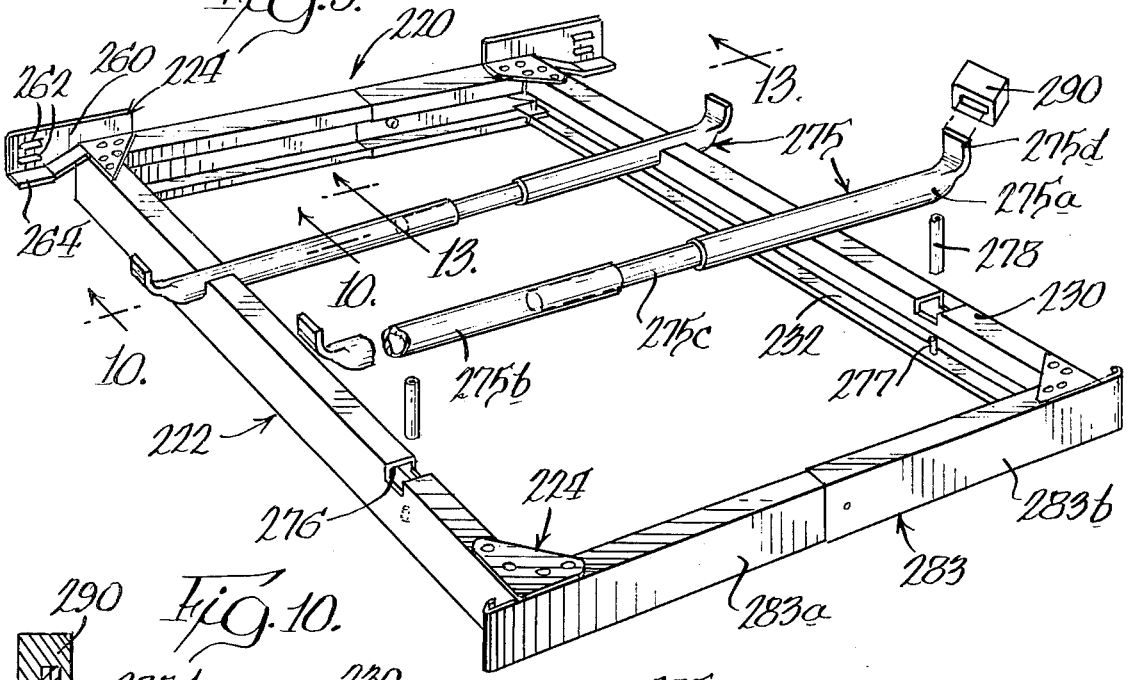
FIG. 9 is a partially exploded perspective view of another embodiment of the present invention.
Figure 15:
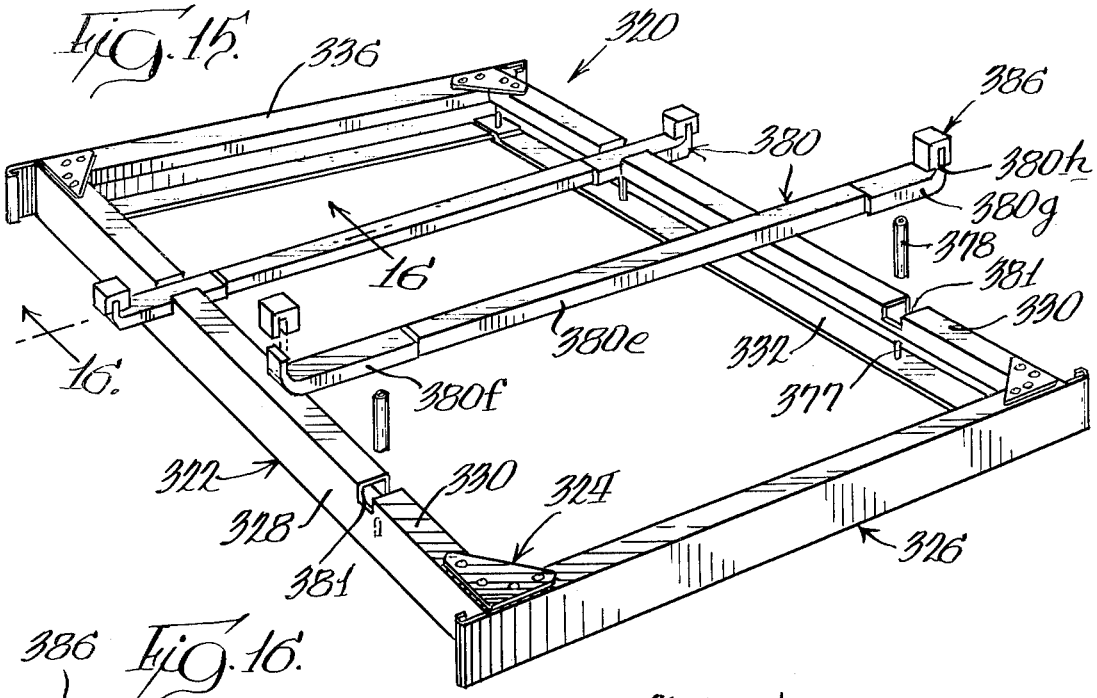
FIG. 15 is a partially exploded perspective view of another embodiment of the present invention.

In the embodiments illustrated in FIGS. 9 and 15, each side plate in platforms 220 and 320 has at least two notches formed in the uppermost portions thereof, and the notches in each side plate are aligned with the notches in the other side plate. At least two cross support members extend between the side plates, and each cross support member is positioned within a pair of aligned notches for supporting the mattress means. In these embodiments, the portion of the cross support members that is received in the notches in the side plates is not coplanar with the upper horizontal members.

Figure 10:
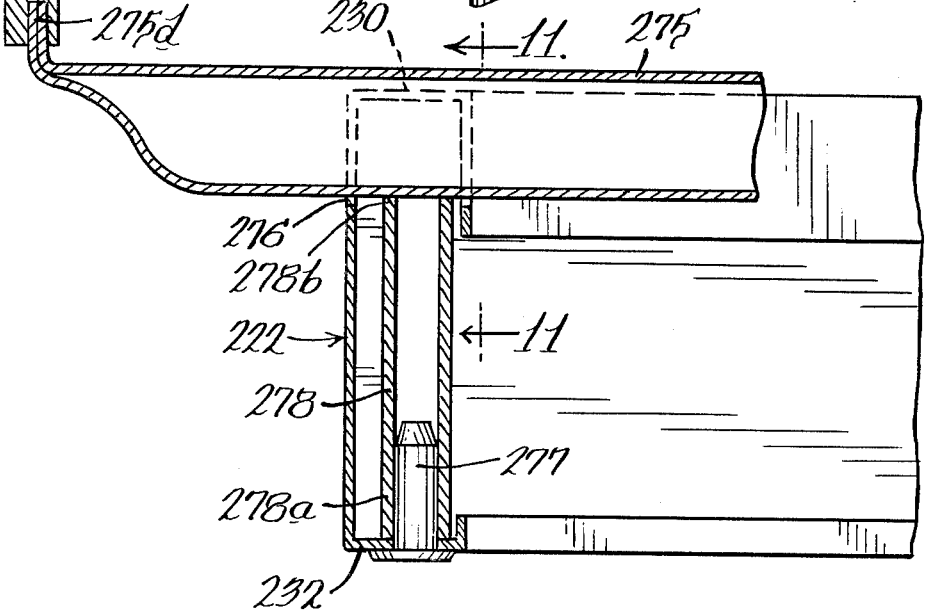
FIG. 10 is an enlarged fragmentary cross-sectional view taken along plane 10—10 in FIG. 9.

Referring to FIGS. 9 and 10, cross support members 275 are closed tubes that are generally cylindrical and hollow. At least those segments of cross support members 275 that are disposed within a pair of aligned notches 276 have an upper surface that is elevated above and offset from the adjacent portions of the upper horizontal members 230. Thus, the height of the upper surface of the cross support members 275 above the floor is greater than the height of the upper horizontal members 230 above the floor. Also, the top surface of the portion of the cross support members disposed between the side plates may be spaced above the floor by a greater distance than the height of the top face of the upper horizontal members above the floor. The cross support members thereby provide the entire support for the mattress.

Figure 11:
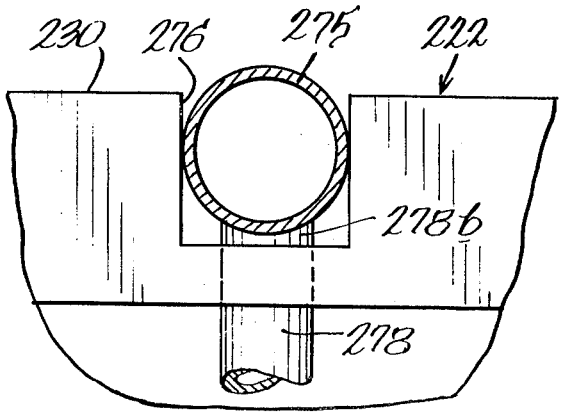
FIG. 11 is a fragmentary cross-sectional view taken along plane 11—11 in FIG. 10.

As shown in FIG. 11, the notches 276 have a width about equal to the outside diameter of the cross support members and the opposing sides of the cross support members are adapted to engage the spaced-apart side walls of the notches to prevent transverse movement of the cross support members. If desired, the notches can have a depth which is less than the outside diameter of the cross support members so that the cross support members would be supported by the bottom wall of the notches and project above the upper horizontal members. Alternatively, as shown in FIGS. 9-11, each horizontal foot portion 232 of the side plates 222 can be provided with upwardly extending locating pins 277 such as rivets that are secured to the foot portion 232. The locating pins 277 are spaced from vertical wall portion 228 and flange 240, and are longitudinally aligned with notches 276, with one locating pin positioned in alignment with each notch. Vertical support members 278 which may comprise closed hollow tubes of cylindrical cross section have one end 278 which receives one of the locating pins 277 and an opposite end **278*b* which is connected to one end of one of the cross support members 275, as by welding. The cross support members are spaced from and do not contact the bottom wall of the notches so that the support members 278 provide virtually all of the vertical support for the cross support members and mattress. The locating pins 277 preferably fit snugly within the support members 278 to prevent longitudinal movement of the cross support members 275. Since the vertical wall portions 228 and upper horizontal members 230** do not support the mattress, they can be made thinner and/or from a less expensive material to lower costs.

Referring to the embodiment shown in FIGS. 15–18, cross support members 380 are closed tubes that are hollow and are generally square or rectangular in cross section. The cross support members have an upper surface **380*a*, lower surface 380*b*, and side walls 380*c* and 380*d*. The cross support members also have a central segment 380*e* and a pair of end segments 380*f* and 380*g* that extend from positions disposed inwardly of flanges 340 through positions disposed outwardly of vertical wall portions 328. As most clearly shown in FIG. 16, the upper surface 380*a* of the cross support members along central segments 380*e* is generally coplanar with the top face of the upper horizontal members 330 (and upper arm portions 336), while the upper surface 380*a* of the end segments 380*f* and 380*g* of the cross support member is positioned below the top face of the upper horizontal members 330. Stated differently the distance between the floor and the upper surface 380*a* of the end segments is less than the distance between the floor and the upper surface 380*a*** of the central segment of each cross support member.

Each cross support member may be a tube which initially is of uniform dimensions along its entire length, and which has the upper surface of the end segments bent downwardly such that the upper surface of the end segments is lower than the upper surface of the central segment, and the width of the end segments may be greater than the width of the central segment.

Portions of the end segments **380*f* and 380*g*, of the cross support members are disposed in notches 381 in the side plates 322. The notches have a width about equal to the width of the end segments 380*f*, and the side walls 380*c* and 380*d* along the end segments 380*f*** of the cross support members are adapted to engage the spaced apart side walls of the notches to prevent transverse movement of the cross support members.

In the embodiment illustrated in FIGS. 15–18, the depth of notches 381 is greater than the height of the central segment **380*e* of the cross support members 380. Each horizontal foot portion 332 of the side plates 322 has upwardly extending locating pins 377 secured thereto which are aligned with the notches 381 and are received in one end 378*a* of a vertical support member 378. The opposite end 378*b* of each vertical support member 378 is connected to end segment 380*f* of one of the cross support members. The bottom wall 380*b* of each cross support member is spaced apart from the bottom wall of notch 381 by means of the vertical support members 378**.

To connect the vertical support members 377 to the cross support members 380, the bottom wall of the end segments **380*f* and 380*g* are provided with apertures 382 having a shape and size about equal to the outside diameter of the vertical support members 380. End 380*b* of each vertical support member 380 is receivable in the apertures and engages the inside face of the top wall of the end segment of the cross support member. The vertical support members provide virtually the entire vertical support for the cross members, but the mattress is supported by the cross support members together with upper horizontal members 330 and upper arm portions 336**.

According to a further feature of the present invention, the platform bed base may be of adjustable width to accommodate mattresses of various widths—e.g., twin size or queen size. Referring to FIG. 9, end plates 283 have telescoping members **283*a* and 283*b*. Since the end plates are generally C-shaped in cross section, the two members are made telescoping by having the dimensions of one member slightly greater than the dimensions of the other member. Similarly, cross support members 275 have telescoping members 275*a* and 275*b*. The cross support members can be made telescoping by making a portion 275*c* of telescoping member 275*a* of smaller outside diameter than the member 275*b* and the remainder of member 275*a*. Portion 275*c* of telescoping member 275*a* is thereby receivable in the axial through aperture which extends through telescoping member 275*b***.

Conventional securement means may be used to releasably lock together the telescoping members of the end plates and cross support members in position relative to one another. For example, the telescoping members of the end plate may be releasably secured together by using the locking means 284 disclosed in commonly assigned U.S. Pat. No. 3,646,623 to Harris, et al. which is incorporated herein by reference to the extent pertinent.

To limit lateral movement of the mattress relative to the platform, upwardly extending stop means is provided at each end of each cross support member. As shown in FIG. 2, the stop means may comprise an upwardly extending terminal portion **46*a* of the cross support member. Since there are frequently small variations (of about one-half inch) in the width of mattresses, the stop means may further include a block 86 which has a front end 86*a* and a back end 86*b* and female means positioned closer to one end than the other. The terminal position 46*a*** of the cross support member comprises male means which is receivable in the female means.

More specifically, the female means comprises a channel **86*c* positioned closer to the front end of the block 86 than to the back end. The block 86 is positioned on the terminal portion 46*a* of the cross support member with the front end 86*a* facing inwardly to accommodate a mattress of a first width (FIG. 2), and is reversible to the position shown in FIG. 5 to accommodate a mattress of a second width which is narrower, and may be removed so that the terminal portion 46*a*** functions as the stop means to accommodate a mattress of a third width which is wider.

Another stop means of adjustable width for limiting lateral movement of the mattress is shown in FIG. 6. Cross support members 172 each define an aperture 186 adjacent each end. The stop means is a generally L-shaped bracket 188 having an axially elongated slot **188*a* along the horizontally extending leg and a vertical leg 188*b* which extends above cross support member 172 to confine the side edge of bedding that is supported thereon. Each slot 188*a* is alignable with a corresponding aperture 187 and the stop means is secured to the cross support member, as by a screw 189** and wing nut 189*a* which is threadably received on the screw. To accommodate mattresses of slightly varying sizes, the wing nut can be tightened again so that the vertical leg 188*b* is positioned in close proximity to the side edge of the bedding on the platform.

Still another stop means is illustrated in FIGS. 9 and 10. The ends 275*d* of cross support members 275 are bent upwardly, and the ends of the cylindrical tube are squeezed so that the inside surface of the wall of the tube is in surface to surface engagement with another portion of the wall. The ends 275*d* can function alone as the stop means. Alternatively, the ends 275*d* comprise male members which are receivable in grooves defined in caps 290 which are generally U-shaped in cross section.

Figure 16:
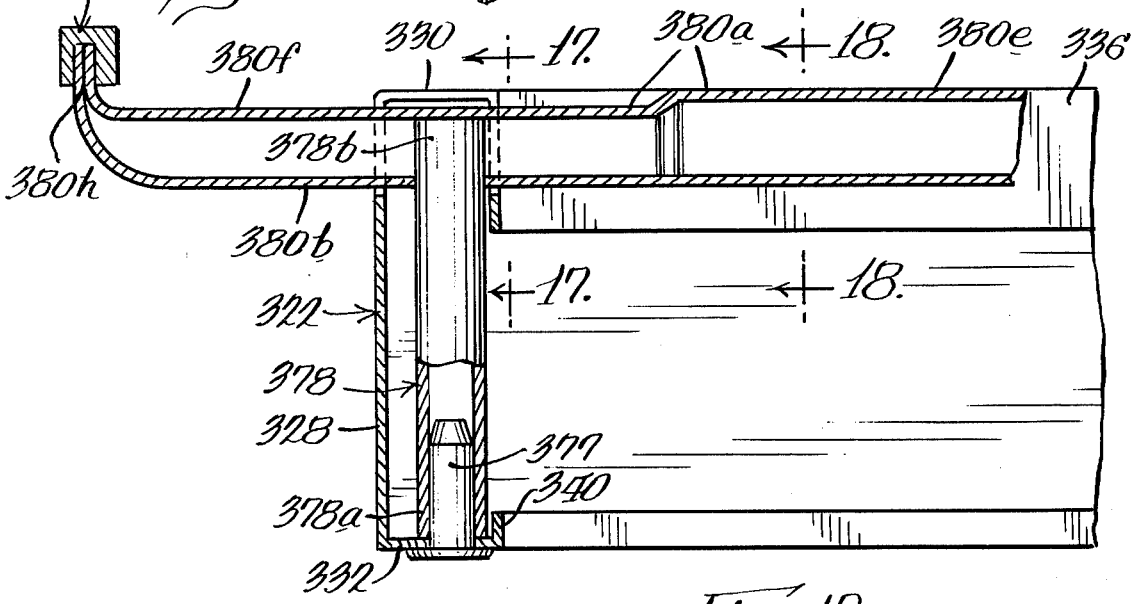
FIG. 16 is an enlarged fragmentary cross-sectional view taken along plane 16—16 in FIG. 15.
Figure 17:
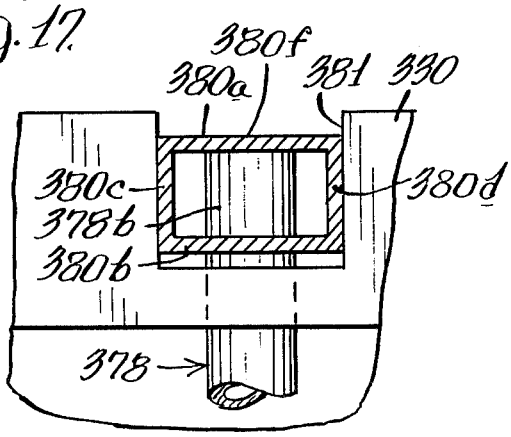
FIG. 17 is a fragmentary cross-sectional view taken along plane 17—17 in FIG. 16.
Figure 18:
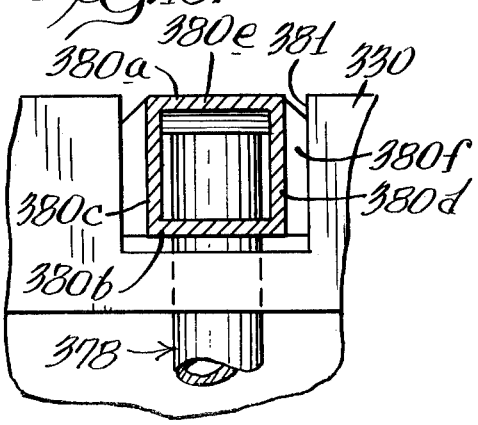
FIG. 18 is a fragmentary cross-sectional view taken along plane 18—18 in FIG. 16.

In the embodiment illustrated in FIGS. 15 and 16, the ends 380*h* of the cross support members are bent upwardly and flattened so that the inside surface of the wall of the tube is in surface to surface engagement with another portion of the wall. The ends 380*h* can function alone as the stop means, or receive blocks 386.

As can be seen from the foregoing, if a mattress and box spring combination is used on the platform, the box spring may be placed directly on the platform with its frame being supported on the generally coplanar surfaces defined by upper horizontal members 30 of side plates 12 and also on upper arm portions 36. If desired, some additional support may be provided by the cross support members, as shown in FIGS. 1, 6 and 15. Alternatively, all of the support may be provided by the cross support members (FIG. 9). Thus, the platform of the present invention may support an ordinary box spring-/mattress combination which is commonly used with Hollywood bed frames. This provides the user with the same degree of sleeping comfort when using a platform bed in accordance with the present invention as is commonly available using Hollywood bed frames. If an ordinary mattress is used without a box spring, it may be supported on a flat board or alternatively on a plurality of cross support members.

I claim:

1. A platform bed frame for supporting mattress means in spaced relationship to a floor, comprising:

a pair of spaced parallel side plates, each side plate having substantially the same dimensions and including a wall portion having an upper edge and a lower edge and disposed generally vertically in relation to the floor, an upper horizontal member integral with the upper edge of the wall portion, and a generally horizontal foot portion integral with the lower edge of the wall portion for confronting the surfaces upon which the platform is situated;

a pair of longitudinally spaced end plates extending substantially transversely between said side plates, each end plate having substantially the same dimensions and including an intermediate portion having an upper edge and a lower edge and disposed generally vertically in relation to the floor, a generally horizontal upper arm portion integral with the upper edge of the intermediate portion, and a generally horizontal lower leg portion integral with the lower edge of the intermediate portion for confronting the surface upon which said platform is situated; and means for detachably securing each of said end plates to each of said side plates to form a generally rectangular platform and comprising bracket means having male means along one major face thereof, the ends of said side plates and end plates being provided with female means, said male means and female means being engageable with one another when the ends of said side plates and end plates are positioned adjacent to one another and said bracket means is positioned with its said major face disposed in surface to surface engagement with the upper horizontal member of the side plate and the horizontal upper arm portion of the end plate.

2. A platform bed frame as set forth in claim 1 wherein said upper horizontal member and said lower horizontal member extend inwardly from said wall portion and said upper arm portion and said lower leg portion extend inwardly from said intermediate portion.

3. A platform bed frame as set forth in claim 2 wherein the ends of said lower horizontal members are positioned in overlapping surface to surface contact with the ends of said foot portions.

4. A platform bed frame as set forth in claim 3 wherein said securing means includes a pin extending upwardly from the lowermost of said overlapping lower horizontal members and foot portions and an aperture in the uppermost of said overlapping lower horizontal members and foot portions, each pin being receivable in one of said apertures.

5. The platform bed frame as set forth in claim 2 wherein said female means includes a pair of spaced apertures in each end of said upper horizontal members and said upper arm portions and said male means includes a plurality of pins extending downwardly from said one major face of said bracket means, the pins in each bracket means being receivable in the apertures at one end of said upper horizontal member and one end of said upper arm portion.

6. A platform bed frame as set forth in claim 5 wherein said bracket means comprises a generally flat plate with said pins projecting outwardly from said one major face.

7. A platform bed frame as set forth in claim 6 wherein said bracket means includes a wall portion disposed generally vertically in relation to the floor and generally perpendicular in relation to said flat plate, said wall portion of said bracket means defining an aperture for securing a headboard to said bracket means.

8. A platform bed frame as set forth in claim 1 wherein at least one notch is formed in the uppermost portions of each side plate, each notch in each side plate being aligned with a notch in the other side plate, and wherein at least one cross support member extends between said side plates and is positioned within a pair of aligned notches for supporting said mattress means.

9. A platform bed frame as set forth in claim 8 wherein said upper horizontal members, said upper arm portions and said at least one cross support member together provide support for said mattress means.

10. A platform bed frame as set forth in claim 8 wherein each cross support member is a tube having a generally circular cross-section and which is curved upwardly between said side plates, said tube being flattened to provide the tube with at least three spaced apart coplanar surface segments extending horizontally along the top of said tube, said coplanar surface segments also being approximately coplanar with said upper horizontal members.

11. A platform bed frame as set forth in claim 8 wherein each notch has a bottom wall and a pair of spaced-apart side walls extending upwardly from said bottom wall, and each cross support member is supported by the bottom wall of each notch, and transverse movement of each cross support member is limited by the side walls of each notch.

12. A platform bed frame as set forth in claim 8 wherein each said cross support member comprises a generally L-shaped member having a generally horizontally extending panel and a vertical panel extending for the length of said horizontal panel and perpendicular thereto, said vertical panel being receivable in an aligned pair of said notches and said horizontal panel being generally coplanar with said upper horizontal members, said horizontal panel and said upper horizontal members and said upper arm portions together providing support for said mattress means.

13. A platform bed frame as set forth in claim 8 wherein each foot portion is provided with locating projecting means extending upwardly therefrom and wherein vertical support members each comprising a closed tube have one end which receives one of said locating projecting means and an opposite end which is connected to one of said cross support members, whereby said vertical support members provide support for said cross support members.

14. A platform bed frame as set forth in claim 13 wherein each notch has a bottom wall and a pair of spaced-apart side walls extending upwardly from said bottom wall, and said bottom wall of said tube is spaced-apart from said bottom wall of said notch by means of said vertical support members.

15. A platform bed frame as set forth in claim 1 wherein at least two notches are formed in the uppermost portions of each side plate, the notches in each side plate being aligned with the notches in the other side plate, and wherein at least two cross support members extend between the side plates and are each positioned within a pair of aligned notches for supporting said mattress means.

16. A platform bed frame as set forth in claim 15 wherein each cross support member has segments at opposite ends thereof disposed within a pair of said aligned notches, said segments having an upper surface elevated above said floor by a distance different from the height of said upper horizontal members above said floor so that said upper surface is offset relative to the unnotched portion of said upper horizontal members.

17. A platform bed frame as set forth in claim 16 wherein the distance between the floor and the upper surface of said segments is less than the distance between the floor and the top face of said upper horizontal members, and the distance between the floor and said top surface is generally equal to the distance between the floor and the top face of said upper horizontal members.

18. A platform bed frame as set forth in claim 15 wherein each cross support member has an upper surface and the entire portion of the upper surface between said side plates and the upper surface of the portion disposed within said aligned pair of notches are spaced above the floor a distance greater than the height of the top face of said upper horizontal members above the floor, whereby said cross support members provide the entire support for said mattress means.

19. A platform bed frame as set forth in claim 8 wherein upwardly extending stop means is provided at each end of each cross support member to limit lateral movement of said mattress means.

20. A platform bed frame as set forth in claim 19 wherein said stop means comprises an upwardly extending portion of said cross support member at each end of said cross support member.

21. A platform bed frame as set forth in claim 20 wherein said upwardly extending portion of said cross member comprises male means and said stop means further includes a stop member having a front end and a back end and female means positioned closer to said front end than said back end, said stop member being positionable on said upwardly extending portion of said cross member with said front end facing inwardly to accommodate mattress means of a first width, and said stop member being reversible so that said back end faces inwardly to accommodate mattress means of a second width, said stop member being removable so that said upwardly extending portion of said cross support member accommodates mattress means of a third width.

22. A platform bed frame as set forth in claim 8 wherein said end plates and said cross support members each include first and second telescoping members for adjusting the width of said platform to accommodate mattress means of various widths, and further including means for releasably locking said first and second telescoping members in position relative to one another.

23. A platform bed frame for supporting mattress means in spaced relationship to a floor, comprising:

a pair of spaced parallel side rails, each side rail having substantially the same dimensions and including a wall portion having an upper edge and a lower edge and disposed generally vertically in relation to the floor, an upper horizontal member integral with the upper edge of the wall portion, and a generally horizontal foot portion integral with the lower edge of the wall portion for confronting the surface upon which the platform is situated;

a pair of longitudinally spaced end rails extending substantially transversely between said side rails, each end rail having substantially the same dimensions and including an immediate portion having an upper edge and a lower edge and disposed generally vertically in relation to the floor, a generally horizontal upper arm portion integral with the upper edge of the intermediate portion, and a generally horizontal lower leg portion integral with the lower edge of the intermediate portion for confronting the surface upon which said platform is situated; and means for detachably securing each of said end rails to each of said side rails to form a generally rectangular platform and comprising a plurality of generally flat plates each having a plurality of pins extending downwardly from one major face thereof, the ends of said side rails and end rails being provided with spaced apertures, the pins in each plate being receivable in the apertures at one end of said upper horizontal member and one end of said upper arm portion when the ends of said side rails and end rails are positioned adjacent to one another and said plate is positioned with its said major face disposed in surface to surface engagement with the upper horizontal member of the side rail and the horizontal upper arm portion of the end rail, said upper horizontal member and upper arm portion being generally coplanar.

24. A platform bed frame for supporting mattress means in spaced relationship to a floor, comprising:

a pair of spaced parallel side rails, each side rail having substantially the same dimensions and including a wall portion having an upper edge and a lower edge and disposed generally vertically in relation to the floor to provide upright support for said mattress means, an upper horizontal member integral with the upper edge of the wall portion and extending inwardly from said wall portion for providing support for a peripheral part of said mattress means, and a generally horizontal foot portion integral with the lower edge of the wall portion and extending inwardly from said wall portion for confronting the surface upon which the platform is situated;

a pair of longitudinally spaced end plates extending substantially transversely between said side plates, each end plate having substantially the same dimensions and including an intermediate portion having an upper edge and a lower edge and disposed generally vertically in relation to the floor to provide upright support for said mattress means, a generally horizontal upper arm portion integral with the upper edge of the intermediate portion and extending inwardly from said intermediate portion for supporting a peripheral part of said mattress means, and a generally horizontal lower leg portion integral with the lower edge of the intermediate portion and extending inwardly from said intermediate portion for confronting the surface upon which said platform is situated; and means for detachably securing each of said end rails to each of said side rails to form a generally rectangular platform and comprising a plurality of generally flat plates each having a plurality of pins extending downwardly from one major face thereof, the ends of said side rails and end rails being provided with spaced apertures, the pins in each plate being receivable in the apertures at one end of said upper horizontal member and one end of said upper arm portion when the ends of said side rails and end rails are positioned adjacent to one another and said plate is positioned with its said major face disposed in surface to surface engagement with the upper horizontal member of the side rail and the horizontal upper arm portion of the end rail, said upper horizontal member and upper arm portion being generally coplanar.

25. A platform bed frame for supporting mattress means in spaced relationship to a floor, comprising:

a pair of spaced parallel side plates, each side plate having substantially the same dimensions and including a wall portion having an upper edge and a lower edge and disposed generally vertically in relation to the floor, an upper horizontal member integral with the upper edge of the wall portion, and a generally horizontal foot portion integral with the lower edge of the wall portion for confronting the surface upon which the platform is situated;

a pair of longitudinally spaced end plates extending substantially transversely between said side plates, each end plate having substantially the same dimensions and including an intermediate portion having an upper edge and a lower edge and disposed generally vertically in relation to the floor, a generally horizontal upper arm portion integral with the upper edge of the intermediate portion, and a generally horizontal lower leg portion integral with the lower edge of the intermediate portion for confronting the surface upon which said platform is situated;

means for securing each of said end plates to each of said side plates to form a generally rectangular platform;

the uppermost portions of each side plate defining at least one notch therein, each notch in each side plate being aligned with a notch in the other side plate, and wherein at least one cross support member extends between said side plates and is positioned within a pair of aligned notches for supporting said mattress means;

locating projecting means extending upwardly from each foot portion; and vertical support members each comprising a closed tube having one end which receives one of said locating projecting means and an opposite end which is connected to one of said cross support members, whereby said vertical support members provide support for said cross support members.

26. A platform bed frame as set forth in claim 25 wherein each notch has a bottom wall and a pair of spaced-apart side walls extending upwardly from said bottom wall, and said bottom wall of each cross support member is spaced-apart from said bottom wall of said notch by means of said vertical support members.

27. A platform bed frame as set forth in claim 25 wherein said upper horizontal members, said upper arm portions and said at least one cross support member together provide support for said mattress means.

28. A platform bed frame as set forth in claim 2 wherein said female means includes at least one aperture in each end of said upper horizontal members and said upper arm portions and said male means includes a plurality of pins extending downwardly from said one major face of said bracket means, the pins in each bracket means being receivable in the apertures at one end of said upper horizontal member and one end of said upper arm portion.

29. A platform bed frame as set forth in claim 28 wherein screw means is provided for additional securement between said side plates and said end plates.

30. A platform bed frame as set forth in claim 29 wherein said bracket means comprises a first bracket which is a generally flat plate with said pins protruding downwardly from said one major face, said first bracket defines an aperture, said upper horizontal members and said horizontal upper arm portions terminate in an inner edge, flanges extend downwardly from the inner edge of said upper horizontal members and said horizontal upper arm portions, said flanges having a lowermost edge, second bracket means is provided and comprises a plate having an upper surface that contacts said lowermost edge of at least two of said flanges, said second bracket means defining an aperture, said screw means comprises a bolt that is receivable through said apertures in said first bracket means and said second bracket means, said bolt having a head that engages a surface of one of said brackets, and nut means is receivable on said bolt and engages a surface of the other of said brackets to provide additional securement between said side plates and said end plates.

31. A platform bed frame as set forth in claim 8 wherein each cross support member is a tube having a generally circular cross-section, said tube being flattened along the top of the portion of the tube received in said notch.

32. A platform bed frame as set forth in claim 16 wherein the distance between the floor and the upper surface of said segments is greater than the distance between the floor and the top face of said upper horizontal members.

33. A platform bed frame as set forth in claim 8 wherein said each cross support member includes first and second telescoping members for adjusting the width of said cross support member.

* * * * *